US009181802B2

(12) United States Patent
Zenisek et al.

(10) Patent No.: US 9,181,802 B2
(45) Date of Patent: Nov. 10, 2015

(54) ROBUST MINE VENTILATION DOOR WITH SINGLE ACTUATION SYSTEM

(71) Applicant: American Mine Door Co., Cleveland, OH (US)

(72) Inventors: Daniel S. Zenisek, Medina, OH (US); Robert H. Chorman, Chardon, OH (US)

(73) Assignee: American Mine Door Co., Cleveland, OH (US)

( * ) Notice: Subject to any disclaimer, the term of this patent is extended or adjusted under 35 U.S.C. 154(b) by 20 days.

(21) Appl. No.: 13/774,378

(22) Filed: Feb. 22, 2013

(65) Prior Publication Data

US 2014/0020296 A1 Jan. 23, 2014

Related U.S. Application Data

(60) Provisional application No. 61/674,007, filed on Jul. 20, 2012, provisional application No. 61/674,046, filed on Jul. 20, 2012, provisional application No. 61/674,088, filed on Jul. 20, 2012.

(51) Int. Cl.

| | |
|---|---|
| ***E21F 1/10*** | (2006.01) |
| ***E06B 1/52*** | (2006.01) |
| ***E05F 17/00*** | (2006.01) |
| ***E05F 15/63*** | (2015.01) |
| ***E06B 3/34*** | (2006.01) |
| ***E06B 5/12*** | (2006.01) |
| *E06B 3/36* | (2006.01) |
| *E05F 15/40* | (2015.01) |
| *E05F 15/73* | (2015.01) |
| *E05F 15/79* | (2015.01) |

(52) U.S. Cl.

CPC . *E21F 1/10* (2013.01); *E05F 15/63* (2015.01); *E05F 17/004* (2013.01); *E06B 1/52* (2013.01); *E06B 3/34* (2013.01); *E06B 5/12* (2013.01); *E05F 15/40* (2015.01); *E05F 15/73* (2015.01); *E05F 15/79* (2015.01); *E05F 2015/763* (2015.01); *E05F 2017/008* (2013.01); *E05Y 2201/62* (2013.01); *E05Y 2800/11* (2013.01); *E05Y 2900/11* (2013.01); *E06B 3/362* (2013.01)

(58) Field of Classification Search

USPC ..... 49/116, 118, 120, 366, 367, 339, 340, 49/344, 345; 454/168, 169

IPC ..... E21F 1/10; E05F 15/63,15/40; E06B 1/52

See application file for complete search history.

(56) References Cited

U.S. PATENT DOCUMENTS 1,374,547 A * 4/1921 Bowman ..... 246/307
1,478,970 A * 12/1923 Liggett et al. ..... 246/127

(Continued)

*Primary Examiner* — Gregory Strimbu

(74) *Attorney, Agent, or Firm* — Richard M. Klein; Fay Sharpe LLP

(57) ABSTRACT

A high-pressure mine door assembly for use in mine shafts, the door assembly configured with opposing wings, which enable the door assembly to open and close quickly. The assembly includes a major hub and a minor hub positioned at or above the cap of the door assembly and coupled together via a connecting bar. A drive mechanism is coupled to the cap and the connecting bar, which facilitates the opening and closing of the wings of the door assembly. The door assembly is configured in a 12-6 pitch orientation, requiring only a ⅔ rotation of the wings to fully open the door assembly to. Such a configuration also negates the effect of air pressure on operation of the door assembly, regardless of the direction of the airflow, with the airflow assisting one wing in opening and the other in closing.

7 Claims, 15 Drawing Sheets

(56) References Cited

U.S. PATENT DOCUMENTS

| | | | | | |
|---|---|---|---|---|---|
| 1,631,416 | A * | 6/1927 | Howard | 49/358 |
| 1,748,448 | A * | 2/1930 | Gurney | 49/388 |
| 5,240,349 | A * | 8/1993 | Kennedy et al. | 405/132 |
| RE36,853 | E * | 9/2000 | Kennedy et al. | 405/132 |
| 6,361,430 | B2 * | 3/2002 | Kitching et al. | 454/169 |
| 6,425,820 | B1 * | 7/2002 | Kennedy et al. | 454/169 |
| 2008/0253841 | A1 * | 10/2008 | Kennedy et al. | 405/144 |
| 2011/0203182 | A1 * | 8/2011 | Kennedy et al. | 49/333 |

* cited by examiner

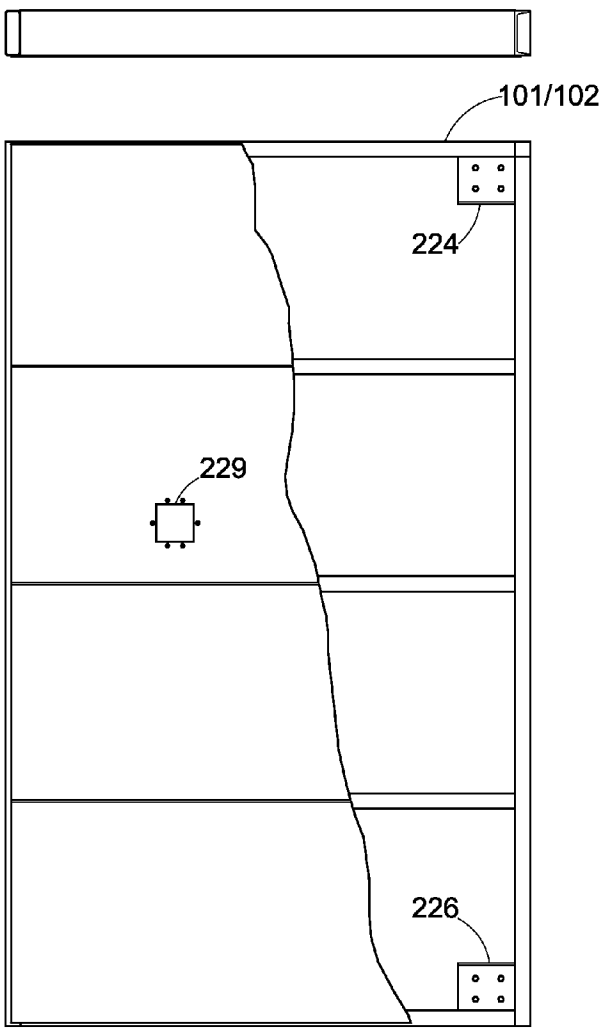
FIG. 10A
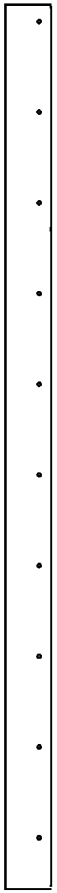
FIG. 10B
FIG. 10C
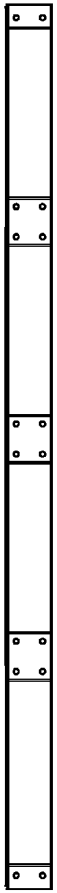
FIG. 10D

ROBUST MINE VENTILATION DOOR WITH SINGLE ACTUATION SYSTEM

CROSS-REFERENCE TO RELATED APPLICATIONS

This application claims priority to U.S. Provisional Application Ser. No. 61/674,046, filed Jul. 20, 2012 and entitled CONTROL SYSTEM FOR MINE VENTILATION DOOR, U.S. Provisional Application Ser. No. 61/674,007, filed Jul. 20, 2012 and entitled ROBUST MINE VENTILATION DOOR WITH SINGLE ACTUATION SYSTEM, and U.S. Provisional Application Ser. No. 61/674,088, filed Jul. 20, 2012 and entitled MINE VENTILATION DOOR WITH WINGS AND SLIDABLE OR POCKET PERSONNEL DOOR, the entirety of which are incorporated by reference herein.

BACKGROUND

The present disclosure is directed to mine doors and more particularly, automated ventilation mine doors utilizing a single actuation mechanism.

Prior to the introduction of automated mine doors, mine operators used "snappers" to open and close doors on the haulage road, so that the motorman would not have to stop. The snapper would open the door, wait for the last car to pass, close the door and then run to get back on the train/tram for the remainder of the trip. In practice, however, often times the motorman would not stop, he would only slow down so that snapper could run ahead of the locomotive and open door. This practice proved unsafe for the miners, the motorman, and detrimental to both the locomotive and the doors.

The advent of machine-assisted mine doors helped alleviate some of the dangers; however such doors still required manual engagement of the machines to open and close the doors. Furthermore, the pressures being exerted on these doors also increased, as ventilation became more effective and powerful due to increases in operating temperatures, depths, mine size, etc. As mines reach greater depths, the size of the doors must increase to accommodate larger and larger equipment, i.e., the easily accessible minerals have already been retrieved, leaving the harder to access deposits farther underground. The increase in size has led accordingly to increases in the power, both applied and consumed, in opening and closing these doors.

The typical mine door includes two wings, which either swing inward or outward, depending upon the configuration. The strength, size, and functional machinery for proper function substantially increase in high-pressure environments. Thus, when either opening or closing, the pressure provides assistance. However, this standard design is hindered in the reverse operation, wherein not only the mass of the doors must be moved, but also the opposing the flow of air must be overcome to properly close the mine doors. As will be appreciated, such standard design is notably hindered in speed of operation as a result of the wings of the door both swinging either inward or outward, as well as negatively impacted by the air pressure, which only helps either open or close and hindering the opposite.

Modern mine doors may be tasked with operating under constant pressures of 400,000 inch/Lb./torque, 800,000 inch/Lb./torque, to even 1,200,000 inch/Lb./torque. As stated above, in most existing mines, the more readily accessible minerals have generally been mined out, requiring the exploitation of veins located deeper underground. In parallel with this depth increase is an increase in the types of vehicles and equipment employed in the mines, as well as an increase in the speed of mining operations that advances in the mining arts have wrought. This increased speed of operations requires that mine doors be capable of operating a large number of cycles each day, e.g., 300 cycles per day, 365 days a year. Due to these demanding conditions, the moving components of a mine door are under increased strain and wear.

Attempts to alleviate some of these issues in high-pressure environments include each wing of the door swinging in an opposite direction. This allows for the high-pressure to facilitate opening and closing of the door, thereby assisting the machinery in the process. A further benefit of such a design includes the coupling of both the top and bottoms of each wing together via respective connecting bars, thus synchronizing the opening/closing of the wings. The power for such wing generally includes at least two pistons or other means of opening or closing the wings. For larger door assemblies, three or more pistons may be utilized, with one piston located at the top of the assembly, a second piston located at the bottom of one wing and the third piston located at the bottom of the other wing. Such embodiments still require an unreasonable amount of time to fully open or close, and may include connecting bars that are frequently damaged by equipment transiting the doorway, e.g., either running over the lower connecting bar or impacting the upper or top connecting bar. These types of mine door embodiments require frequent maintenance and repair due to the damage from machinery and the number of operating components.

Accordingly, what is needed is an automated, high-pressure mine door to provide economical, safe, efficient, durable, and practical ventilation control for all types of track and trackless mines, including, e.g., coal, uranium, salt, gypsum, clay, gold, potash, titanium, copper, molybdenum, platinum, etc. Furthermore, a high-pressure door configured for faster openings/closings, simplified mechanical operations, and durability is needed.

BRIEF DESCRIPTION

One aspect of the present disclosure discussed herein is drawn to a high-pressure mine door assembly for use in mine shafts. The high-pressure mine door assembly is used to control the flow of air to portions of a mine, to form airlocks within a tunnel, to prevent gases or dust from entering or exiting a shaft, and the like. The high-pressure mine door assembly is configured with opposing wings, which enable the door to open and close quickly. Such a configuration also negates the effect of air pressure on operation of the door, as regardless of the direction of the airflow; the airflow will assist one wing in opening and the other in closing.

In another aspect, a high-pressure mine door assembly includes a frame having a cap frame portion, a sill frame portion, a first post frame portion and a second post frame portion, the cap frame portion and the sill frame portion coupled to respective top and bottom ends of the first post frame and second post frame portions. The cap frame portion and the sill frame portion are positioned at a 12/6 pitch relative to the first post frame and second post frame portions. The assembly also includes a major wing pivotally coupled to a cap frame portion via a major cap bearing and a sill frame portion via a major sill bearing, the major wing including a major hub located adjacent to the major cap bearing, and a minor wing pivotally coupled to the cap frame portion via a minor cap bearing and a sill frame portion via a minor sill bearing, the minor wing including a minor hub located adjacent to the minor cap bearing. The high-pressure mine door assembly further includes a connecting bar having a first end moveably coupled to the major hub and a second end moveably coupled to the minor hub, and a single drive assembly operatively coupled to the connecting bar and configured to open and close the major and minor wings of the mine door assembly in opposing directions.

Included in further embodiments is a major hub that comprises a foot having an attachment portion at a first end configured to be moveably coupled to the first end of the connecting bar. The major hub also includes a major hub arm including a first end and a second end, the first end including a hub arm cap attached thereto, and an arm top plate coupled to a top portion of the major hub arm, the arm top plate including a first hole and a second hole. In addition, the major hub includes a forearm, the forearm including an end portion coupled to a bottom portion of the foot, located at a second end opposite the first end of the foot, the forearm extending through the first hole of the top plate and the major hub arm, and a forearm cap coupled to an end of the forearm opposite the end portion coupled to the bottom portion of the foot. Furthermore, the major hub includes a major hub backing plate coupled to the second end of the major hub arm, the major hub backing plate configured to couple the major hub to the major wing. The second hole may be configured to receive a pivot pin of the major wing, the pivot pin allowing pivotal engagement of the major wing with respect to the cap frame portion.

In particular embodiments, the minor hub comprises a foot having an attachment portion at a first end configured to be moveably coupled to the second end of the connecting bar, and a minor hub arm including a first end and a second end, the first end including a hub arm cap attached thereto. The minor up also includes an arm top plate coupled to a top portion of the minor hub arm, the arm top plate including a first hole and a second hole, and a forearm, the forearm including an end portion coupled to a bottom portion of the foot, located at a second end opposite the first end of the foot, the forearm extending through the first hole of the top plate and the minor hub arm. In addition, the minor hub includes a forearm cap coupled to an end of the forearm opposite the end portion coupled to the bottom portion of the foot, and a minor hub backing plate coupled to the second end of the minor hub arm, the minor hub backing plate configured to couple the minor hub to the minor wing. The second hole may be configured to receive a pivot pin of the minor wing, the pivot pin allowing pivotal engagement of the minor wing with respect to the cap frame portion.

Included in other embodiments is a control system operative to receive outputs from one or more sensors that sense the presence of an object or person in proximity to or in the path of the wings. The control system is configured to control the opening and closing of the wings via operation of the drive mechanism.

Another aspect of the present disclosure includes a hub for pivotally coupling a wing to at least one of a cap frame portion or a sill frame portion of a high-pressure mine door assembly. The hub includes a foot having an attachment portion at a first end configured to be moveably coupled to a first end of a connecting bar, the connecting bar operative to couple the wing to an opposing wing. The hub further includes a hub arm that has a first end and a second end, and an arm top plate coupled to a top portion of the hub arm, the arm top plate including a first hole and a second hole. The hub also includes a forearm having an end portion coupled to a bottom portion of the foot, located at a second end opposite the first end of the foot, the forearm extending through the first hole of the top plate and the hub arm. In addition, the hub includes a hub backing plate coupled to the second end of the hub arm, the hub backing plate configured to couple the hub to the wing.

These and other non-limiting aspects and/or objects of the disclosure are more particularly described below.

BRIEF DESCRIPTION OF THE DRAWINGS

The following is a brief description of the drawings, which are presented for the purposes of illustrating exemplary embodiments disclosed herein and not for the purposes of limiting the same.

FIG. 10A illustrates a detailed view of a wing panel assembly for a major wing or minor wing for use in the high-pressure door assembly depicted in FIGS. 1A-4.

FIG. 10B illustrates a detailed first side view of a wing panel assembly for a major wing or minor wing for use in the high-pressure door assembly depicted in FIGS. 1A-4 opposite the wing panel having the personnel access door.

FIG. 10C illustrates a top detailed view of a wing panel assembly for a major wing or minor wing for use in the high-pressure door assembly depicted in FIGS. 1A-4 opposite the wing panel having the personnel access door.

FIG. 10D illustrates a detailed second side view of a wing panel assembly for a major wing or minor wing for use in the high-pressure door assembly depicted in FIGS. 1A-4 opposite the wing panel having the personnel access door.

DESCRIPTION

Figures 1A, 1B, 1C, 1D:
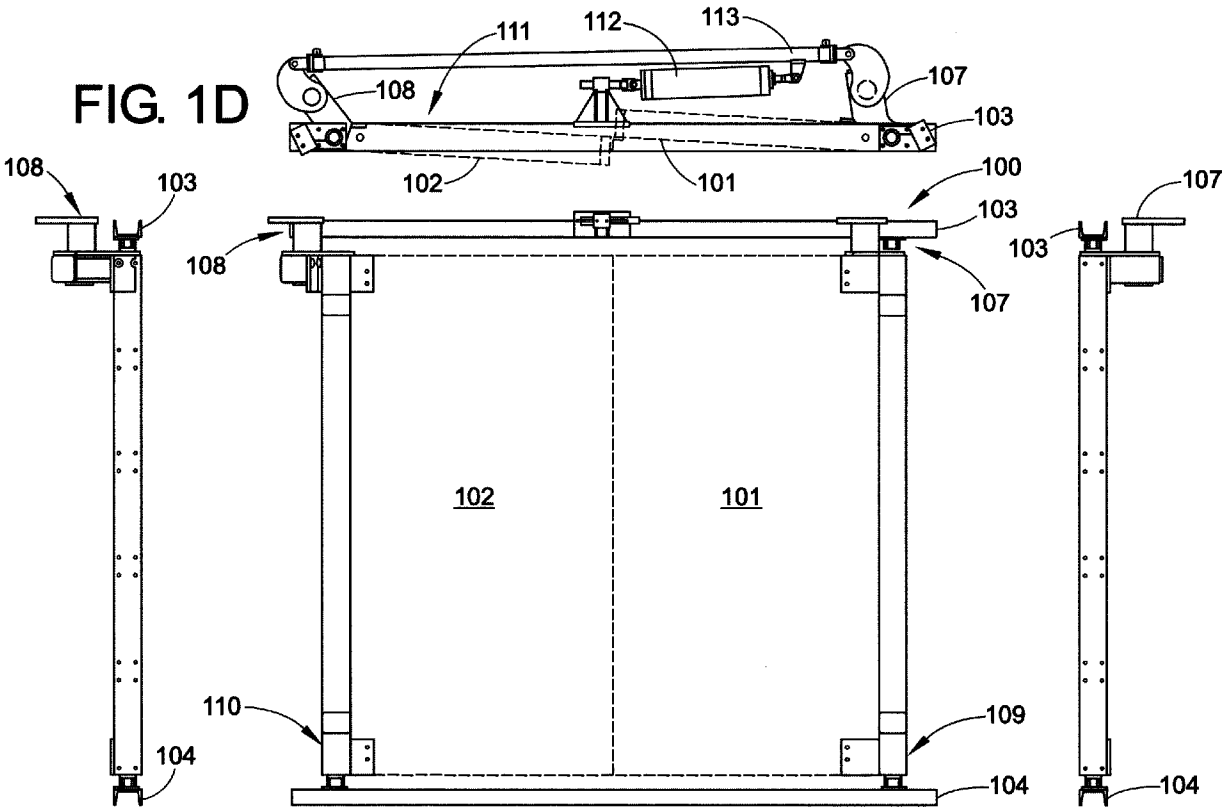
FIG. 1A illustrates a front view of a schematic representation of a high-pressure door assembly in accordance with one embodiment of the present disclosure.
FIG. 1B illustrates a side view of the minor wing of the schematic representation of a high-pressure door assembly in accordance with one embodiment of the present disclosure.
FIG. 1C illustrates a side view of the major wing of the schematic representation of a high-pressure door assembly in accordance with one embodiment of the present disclosure.
FIG. 1D illustrates a top view of the schematic representation of a high-pressure door assembly in accordance with one embodiment of the present disclosure.
Figure 1E:
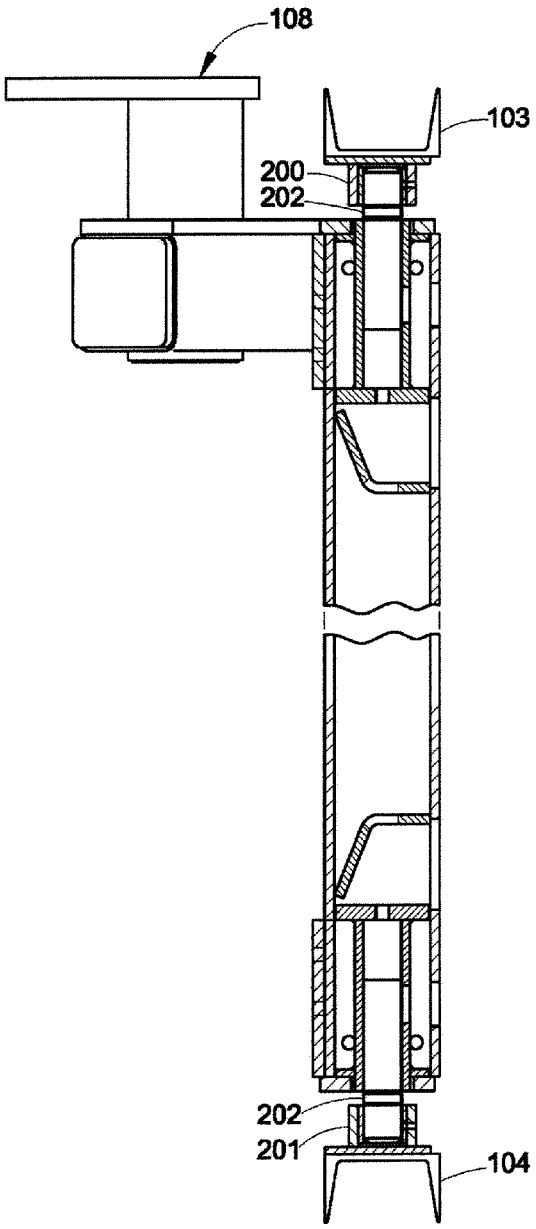
FIG. 1E illustrates a first cross-sectional side view of top and bottom portions of the minor wing hub and bearing for a high-pressure door assembly in accordance with one embodiment of the present disclosure.
Figure 1F:
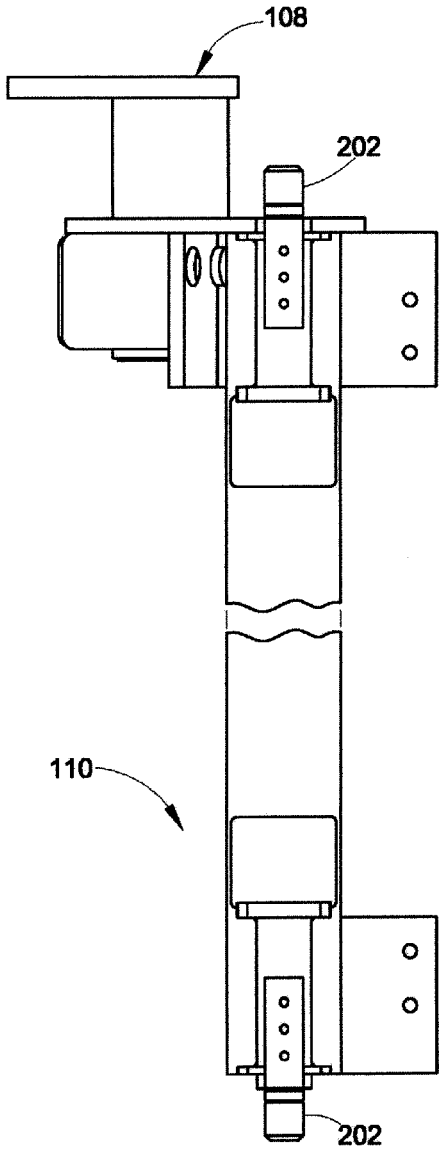
FIG. 1F illustrates a second side view of top and bottom portions of the minor wing hub and bearing for a high-pressure door assembly in accordance with one embodiment of the present disclosure.
Figure 1G:
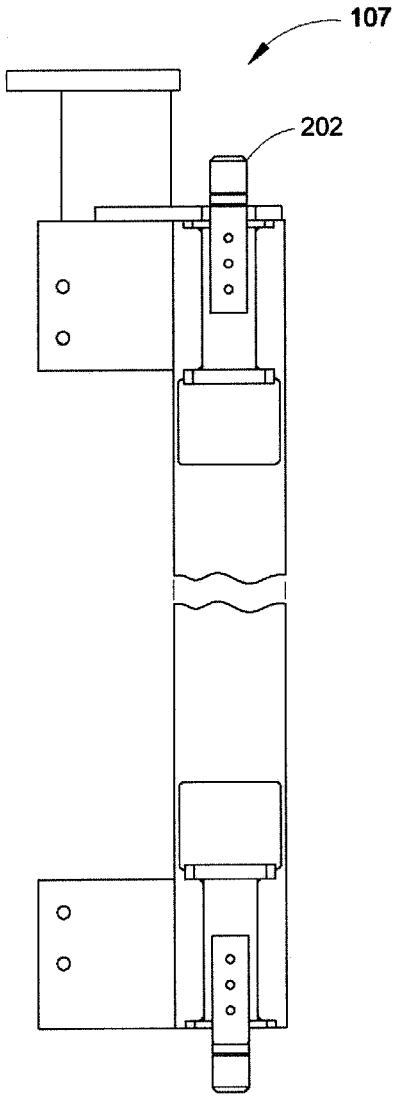
FIG. 1G illustrates a first side view of top and bottom portions of the major wing hub and bearing for a high-pressure door assembly in accordance with one embodiment of the present disclosure.
Figure 1H:
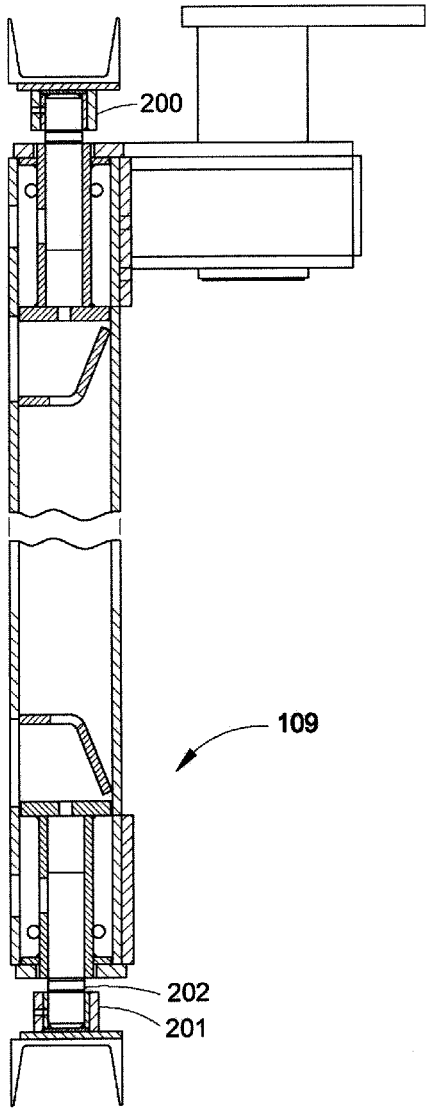
FIG. 1H illustrates a second cross-sectional side view of top and bottom portions of the minor wing hub and bearing for a high-pressure door assembly in accordance with one embodiment of the present disclosure.

One or more implementations of the subject application will now be described with reference to the attached drawings, wherein like reference numerals are used to refer to like elements throughout.

Turning now to FIGS. 1A-4, there are shown several illustrations of the various components of a high-pressure mine door assembly and installation in accordance with one embodiment of the present disclosure. FIG. 1A depicts a front view of the mine door assembly 100 including a major wing 101, a minor wing 102, and frame components cap 103, sill 104, a first post 105 (shown in FIGS. 3-4) and a second post 106 (shown in FIGS. 3-4).

Also illustrated in FIGS. 1A-1C are the major hub 107, the minor hub 108, major sill bearing assembly 109, and the minor sill bearing assembly 110. As illustrated in FIGS. 1B, 1C, 1E, 1H, the cap 103 includes bearings 200 operative to receive pins 202 extending upward from the wings 101-102 so as to enable the rotation of the wings 101-102 with respect to the stationary cap 103 (shown in FIG. 1D). Similarly, the sill 104 includes bearings 201 (i.e., portions of the sill bearing assemblies 109-110) operative to receive pins 202 extending downward from the wings 101-102 so as to enable the rotation of the wings 101-102 with respect to the stationary sill 104. In some embodiments, hardened pins 202 and bronze or other durable materials may be used in the bearings 200-201. The wings 101-102 may further include seals, gaskets, or the like, to prevent airflow from circumventing the door assembly 100.

Expanded views of the major hub 107, the minor hub 108, major sill bearing assembly 109, and the minor sill bearing assembly 110 are also illustrated in FIGS. 1E-1H as shown. A top view 111 is presented in FIG. 1D illustrating the connection of a drive mechanism 112 to the cap 103 and the major hub 107 and minor hub 108, the major and minor wings 101-102 being connected via the connecting bar 113 that is engaged by the drive mechanism 112 to open and close the wings 101-102. As illustrated in the subsequent figures, the connecting bar 113 is moveably coupled to the major hub 107 and the minor hub 108 via pins 131. The drive mechanism 112 may be any suitable mechanism for opening and closing the wings 101-102 including, for example, hydraulic, pneumatic, manual, electronic, or the like. The drive mechanism 112 may include cushions so as to allow for faster cycling of the door assembly 100, e.g., located at opposing ends of an hydraulic or pneumatic driven cylindrical actuator. When implemented, the cushion effect provided by such cushions may affect a portion of the stroke of the cylindrical actuator, e.g., 2 inches, 4 inches, or the like, depending on the length of the stroke, the size of the door, etc. It will be appreciated that such cushions may be adjustable and may be manipulated to achieve certain rates of cushioning, dependent upon the individual needs of the mine in which the doors are implemented. Accordingly, such cushions may increase door speed travel and prevent damage to the door assembly 100.

As depicted in FIG. 1D, a single drive mechanism 112 is advantageously used, one end coupled to the cap frame portion 103 and the drive portion coupled to a pivot on the connecting bar 113 above the major wing 101. Upon engagement of the drive mechanism 112, the drive portion forces the connecting bar 113 to move, thereby opening the wings 101-102 of the door assembly 100. It will be appreciated that the configuration of the hubs 107 and 108, as illustrated by the feet thereof (discussed below) facilitate the fast opening and closing of the wings. Furthermore, placement of the drive mechanism 112 and connecting bar 113 parallel with or slightly above the bottom of the cap frame portion 103 prevents damage to the mechanism 112 and bar 113 by equipment transiting through the door assembly 100. The drive mechanism 112 may also be located midway between the cap frame portion 103 and the sill frame portion 104, with the corresponding connecting bar 113 operatively coupled at the cap portion 103 or frame portion 104 and the drive mechanism 112 to one of the major or minor wings 101-102.

Figure 2A:
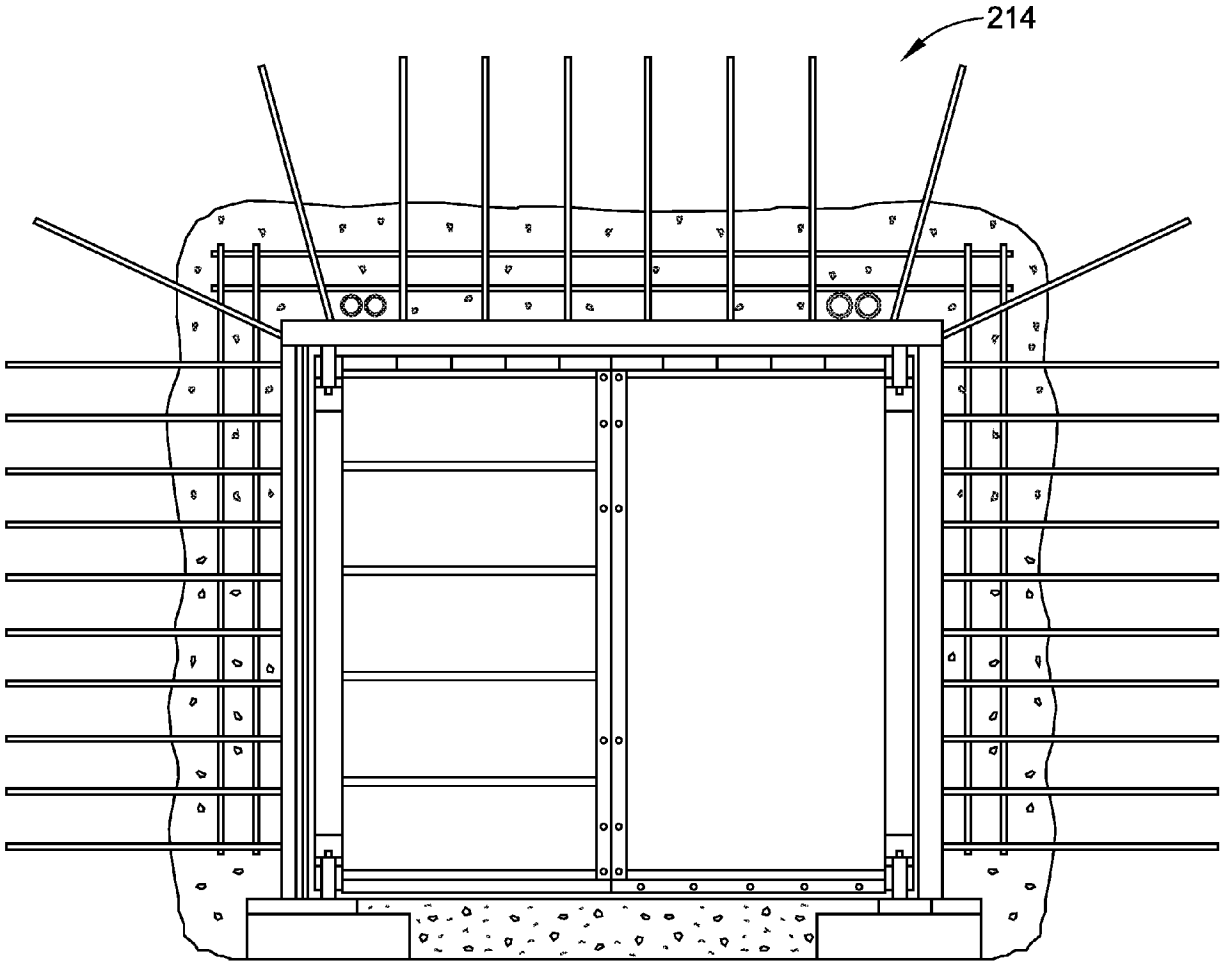
FIG. 2A illustrates a schematic representation of a high-pressure door assembly installation in accordance with one embodiment of the present disclosure.
Figure 2C:
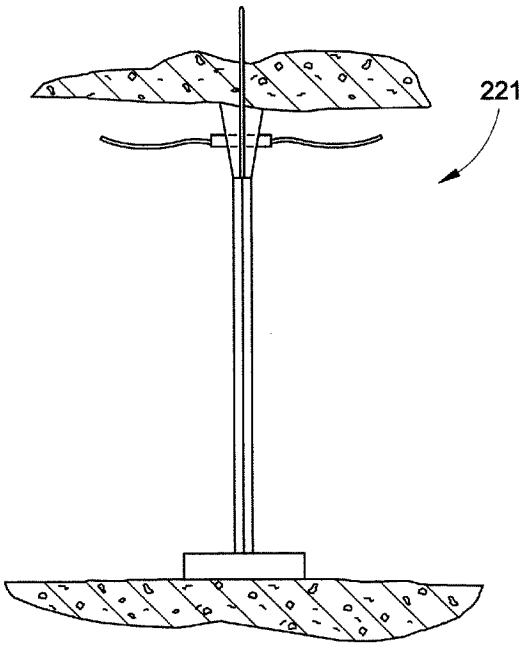
FIG. 2C illustrates a cross-sectional view of the schematic representation of a high-pressure door assembly installation in accordance with one embodiment of the present disclosure.
Figure 2B:
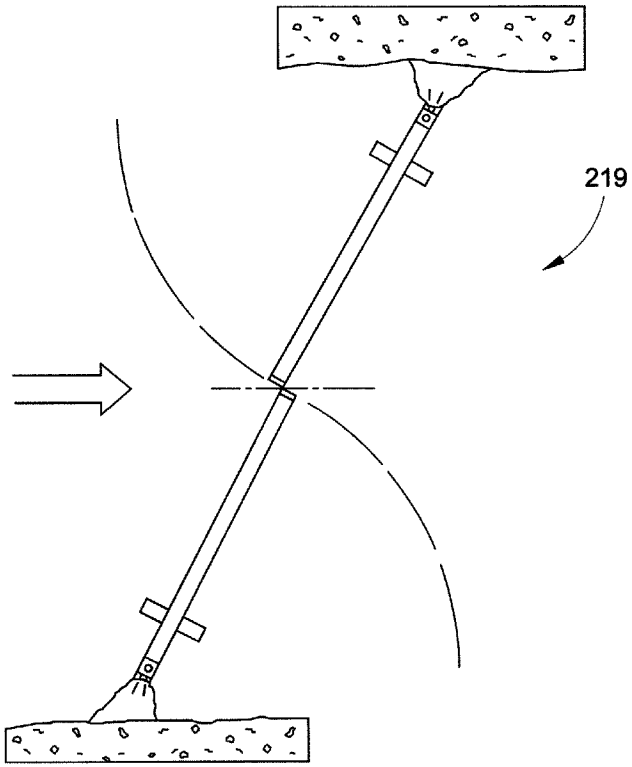
FIG. 2B illustrates a top view of the schematic representation of a high-pressure door assembly installation in accordance with one embodiment of the present disclosure.

FIGS. 2A-2C illustrate an installation 214 of the mine door assembly 100. FIG. 2A depicts a front view of the installation 214, illustrating the securing of the cap 103, sill 104, and sides of the mine door assembly 100 to the surrounding ventilation/mine shaft. FIG. 2B is a side view 219 of the installation 214 shown in FIG. 2A depicting the slanted orientation of the assembly 100 to facilitate faster opening of the wings 101-102. FIG. 2C illustrates a cross-sectional view 221 of the installation 214, 219 of the mine door assembly 100 shown in FIGS. 2A-2B. As previously discussed, the speed with which a mine door cycles open and closes has an impact on the overall operation of the mine, i.e., the speed with which equipment, personnel or ore may transit a mine shaft. Current implementations of mine doors may require 45-50 seconds to cycle open, with a corresponding time to cycle close. In contrast, the subject embodiments employ a cantilevered or offset implementation, wherein the wings 101-102 of the mine door 100 open from 9 to 16 seconds, in accordance with the size of the door. To achieve such speed, the wings 101-102 are positioned at a 12/6 pitch orientation, thereby reducing the distance required to open and close the wings 101-102. That is, each wing 101 and 102 need swing open two-thirds to allow full access to the shaft. In one particular embodiment, each wing 101 and 102 swings open approximately 63° to allow full access to the shaft.

Pairs of such high-pressure door assemblies 100 may be emplaced in a mine shaft so as to facilitate the formation of an airlock therebetween. Such an airlock may be used to prevent outgassing or in gassing to unused portions of a mine, to prevent dust accumulation in non-working sites, to send air to the face of the mine (where current mining is occurring), to control the amount of airflow through the shaft, or the like. For example, a mine operator may want to restrict the flow of air to a certain portion of the mine, but may still need to get equipment through. In order to facilitate this traffic, the airlock is formed of a set of two or more door assemblies. One door will open while the other remains closed. Once the traffic has transited the open door, that door will close following which the next door opens. Previous mine doors made this a long and arduous process. In contrast, the orientation and design of the subject high-pressure mine door assembly 100 facilitates faster opening and closing, while also making such opening easier to accomplish due to the opposing wing design, i.e., one door wing comes forward and the other door wing goes backwards in synchronization via the connecting bar 113.

Figure 3:
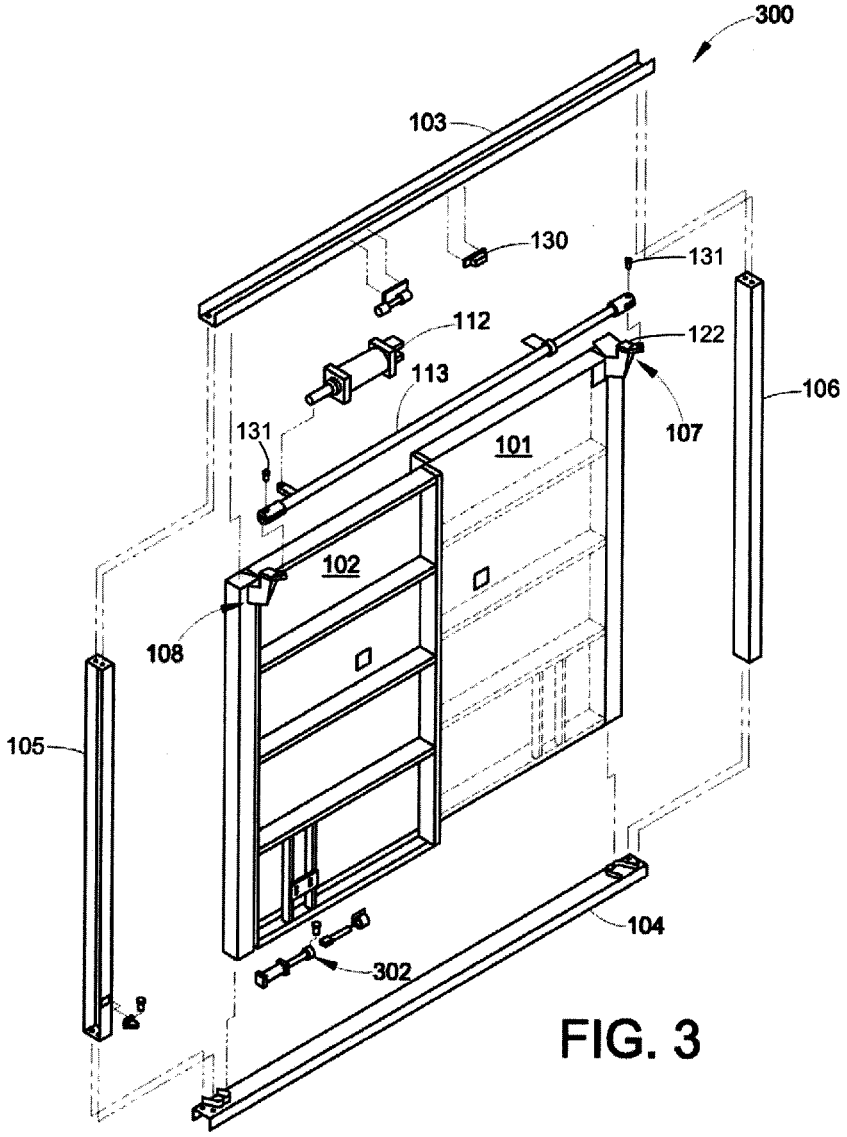
FIG. 3 illustrates an alternate high-pressure mine door assembly in accordance with one embodiment of the present disclosure.
Figure 4:
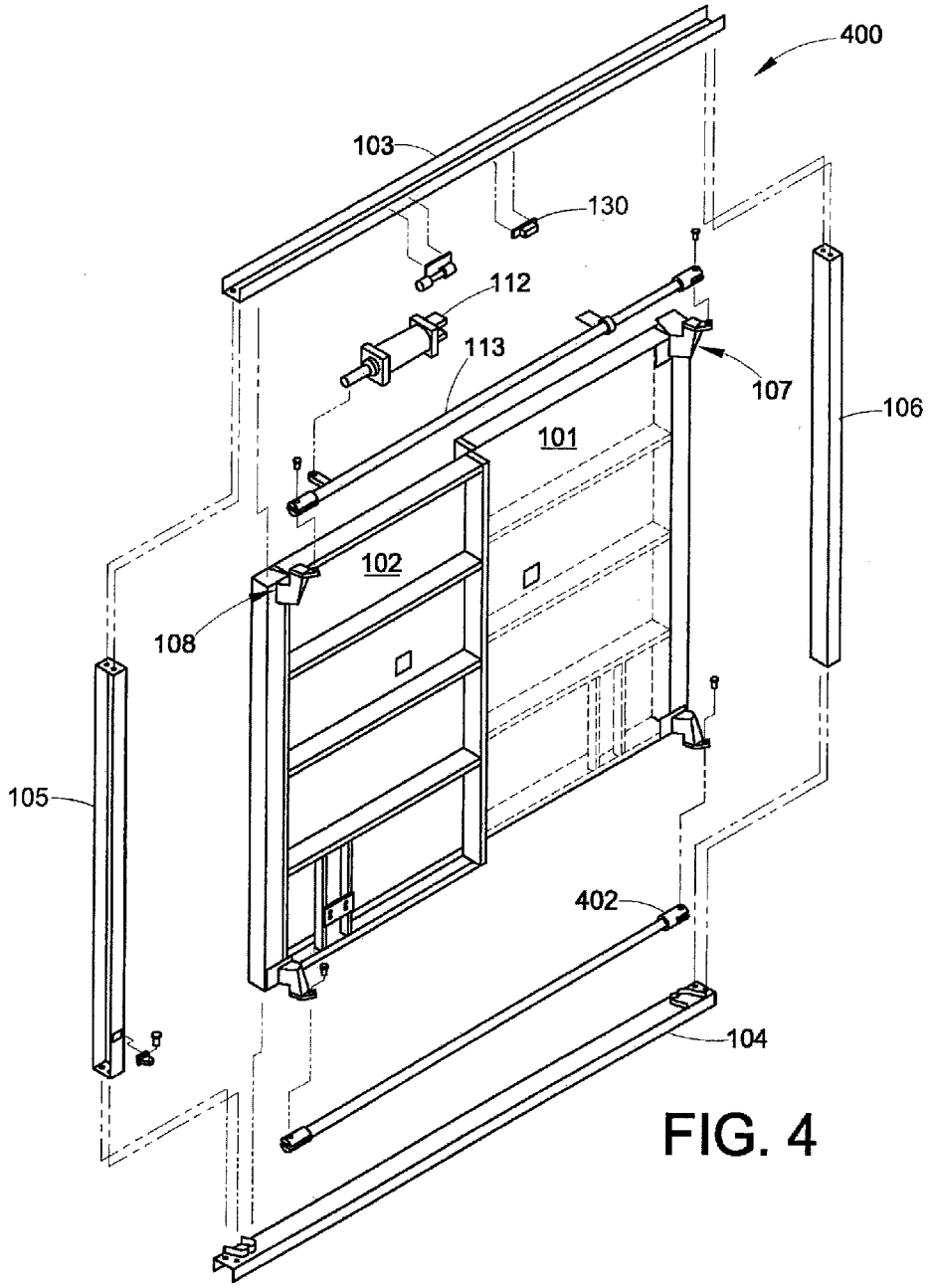
FIG. 4 illustrates another alternate high-pressure mine door assembly in accordance with one embodiment of the present disclosure.
Figure 5C:
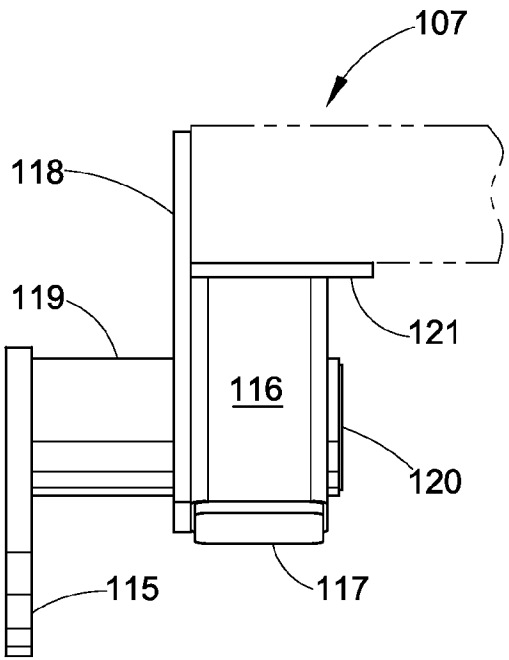
FIG. 5C illustrates a second side view of the major top hub for use in the high-pressure door assembly depicted in FIGS. 1A-4.
Figure 5B:
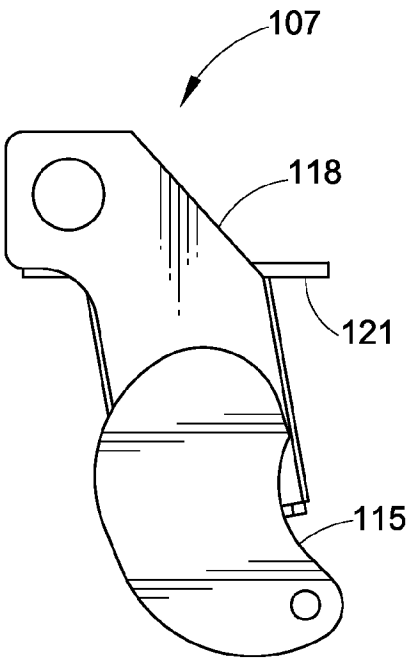
FIG. 5B illustrates a top view of the major top hub for use in the high-pressure door assembly depicted in FIGS. 1A-4.
Figure 5A:
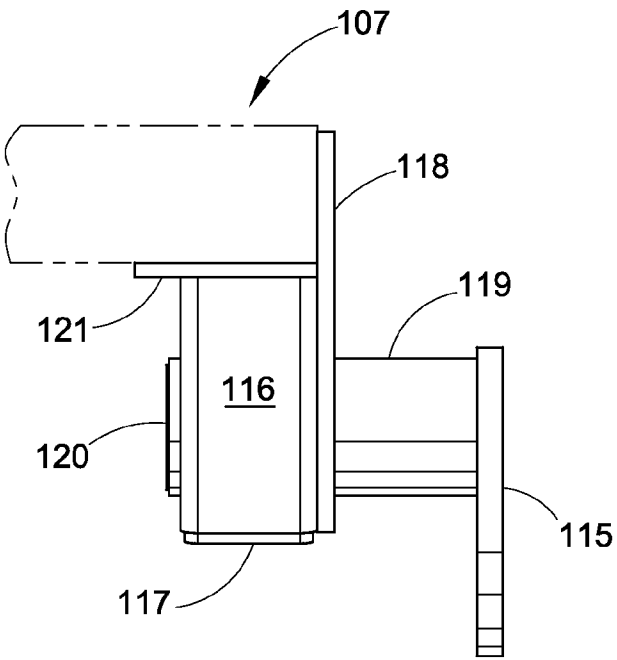
FIG. 5A illustrates a first side view of the major top hub for use in the high-pressure door assembly depicted in FIGS. 1A-4.
Figure 5E:
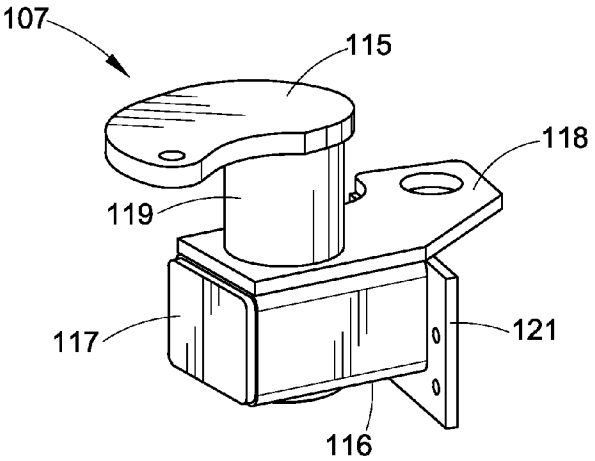
FIG. 5E illustrates a left isometric view of the major top hub for use in the high-pressure door assembly depicted in FIGS. 1A-4.
Figure 5D:
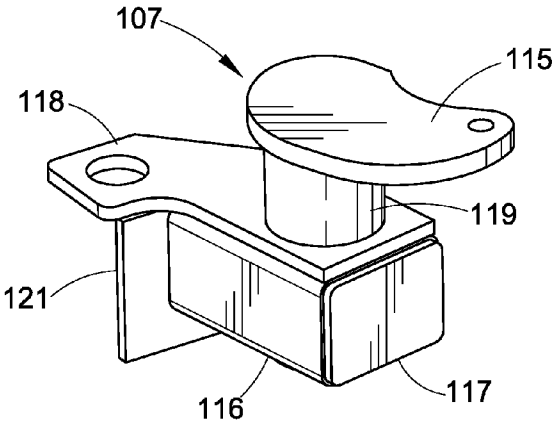
FIG. 5D illustrates a right isometric view of the major top hub for use in the high-pressure door assembly depicted in FIGS. 1A-4.
Figure 5F:
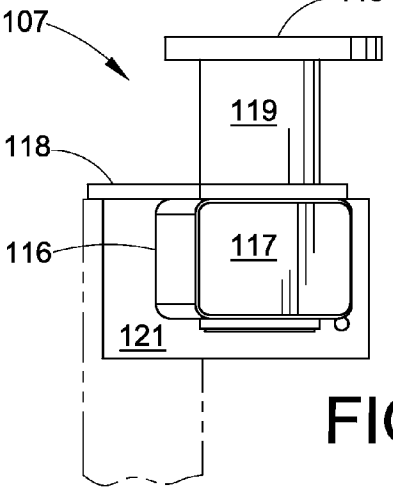
FIG. 5F illustrates a front isometric view of the major top hub for use in the high-pressure door assembly depicted in FIGS. 1A-4.

FIGS. 3-4 illustrate alternate implementations of mine door assemblies 300 and 400 at the suitable 12-6 orientation. As shown in FIG. 3, the mine door assembly 300 includes a supplemental drive 302 coupled to the lower portion of the minor wing 102. The mine door assembly 400 of FIG. 4 includes a secondary connecting bar 402, coupling the bottom portions of the minor wing 102 and the major wing 101. Although not shown in FIGS. 3 and 4, either wing 101 or 102 may include a personnel access door as illustrated in FIGS. 5A-9D, discussed in greater detail below.

As illustrated in FIGS. 1A-2C, the high-pressure mine door assembly 100 includes major wing 101 and a minor wing 102, with the wings 101-102 coupled together by a top-mounted connecting bar 113 located at least parallel to or slightly above the cap frame portion 103 to which the wings 101-102 are rotatably coupled via the hubs 107-108. Each wing 101-102 is further coupled to the sill frame portion 104 via sill hubs 109-110. As illustrated, each wing 101-102 swings in opposing directions and is driven to open or close via at least one drive mechanism 112 operative on the connecting bar 113. As illustrated in greater detail below with respect to FIGS. 5A-10D, each hub assembly 107-108 includes a pivot point located above the wing and extending perpendicularly from the top frame portion. In one embodiment, the pivot bearings use bronze bushings and hardened pins, which lend strength and durability to the mine doors of the present disclosure.

Figure 6:
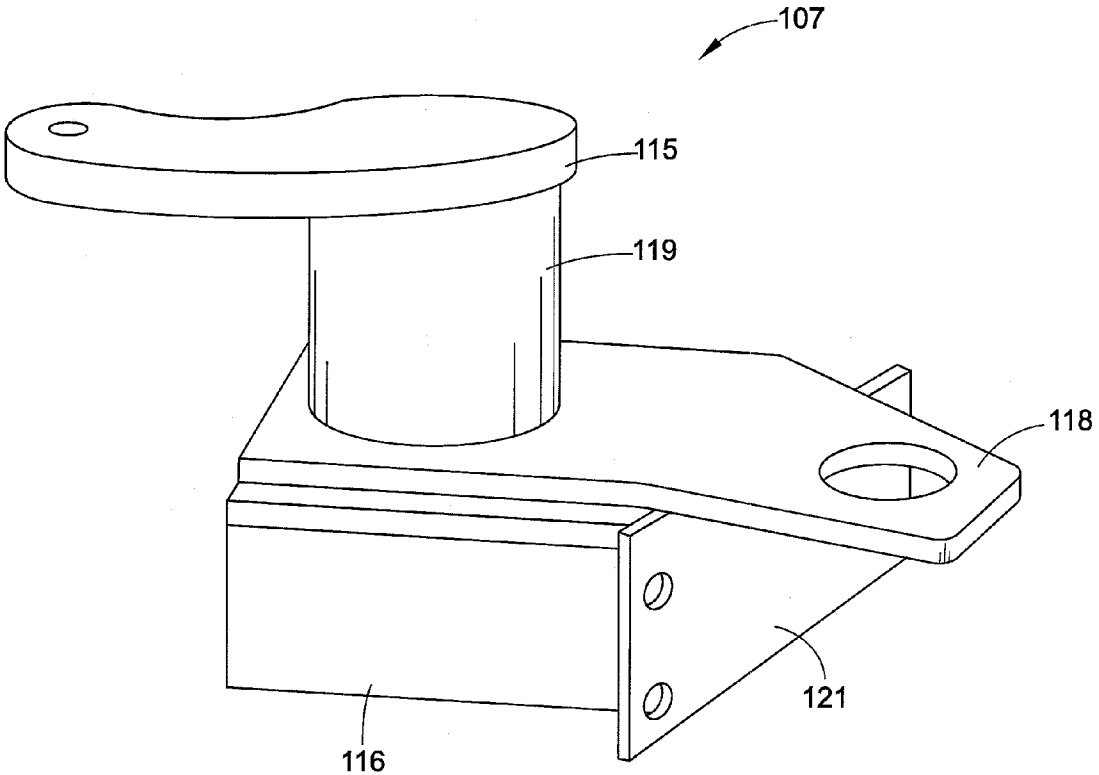
FIG. 6 illustrates a top isometric view of the major top hub in accordance with the detailed and isometric representations illustrated in FIGS. 5A-5F.
Figure 7:
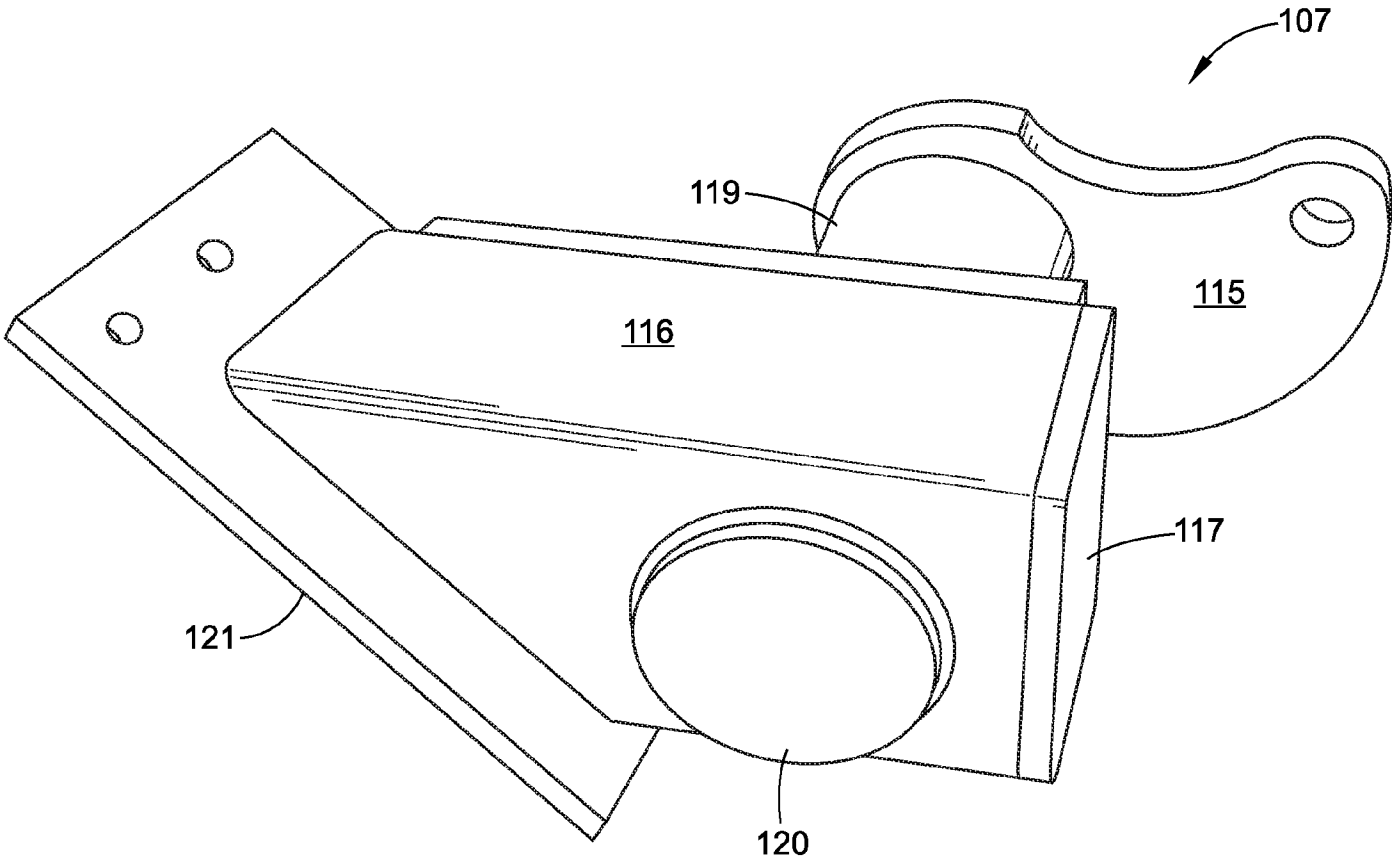
FIG. 7 illustrates a bottom isometric view of the major top hub in accordance with the detailed and isometric representations illustrated in FIGS. 5A-5F.
Figure 8C:
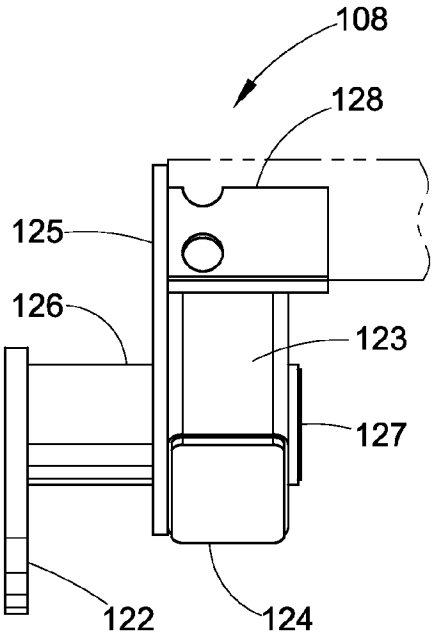
FIG. 8C illustrates a second side view of the minor top hub for use in the high-pressure door assembly depicted in FIGS. 1A-4.
Figure 8B:
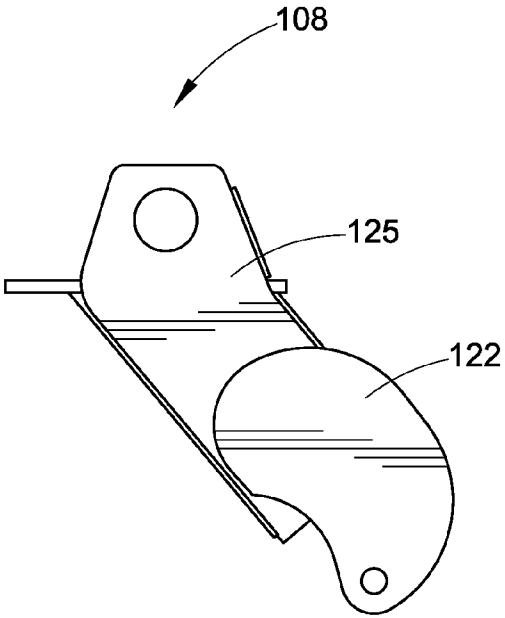
FIG. 8B illustrates a top view of the minor top hub for use in the high-pressure door assembly depicted in FIGS. 1A-4.
Figure 8A:
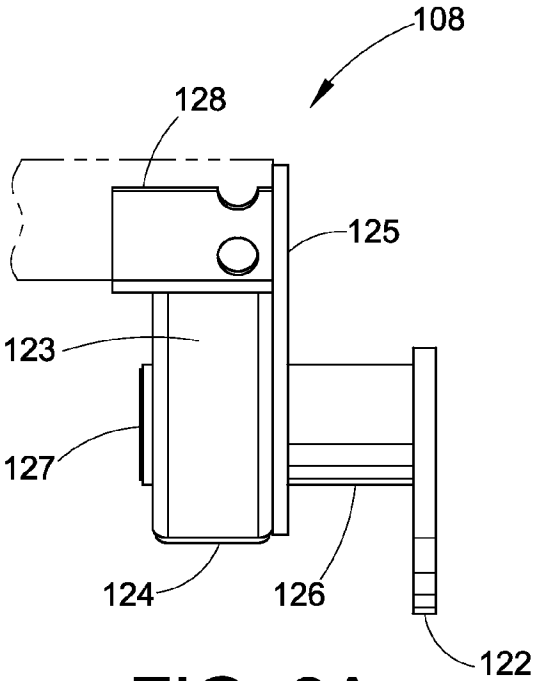
FIG. 8A illustrates a first side view of the minor top hub for use in the high-pressure door assembly depicted in FIGS. 1A-4.
Figure 8E:
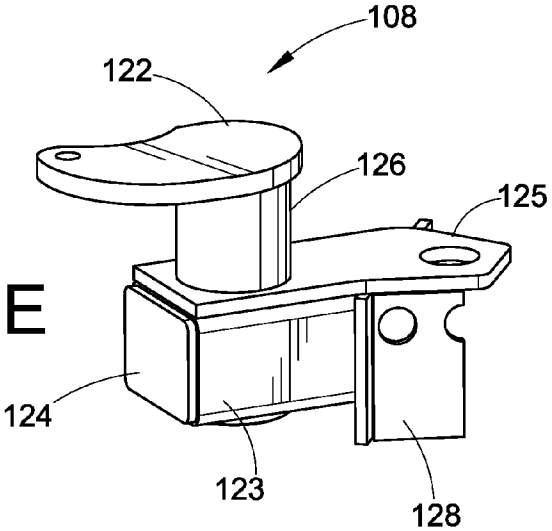
FIG. 8E illustrates a left isometric view of the minor top hub for use in the high-pressure door assembly depicted in FIGS. 1A-4.
Figure 8D:
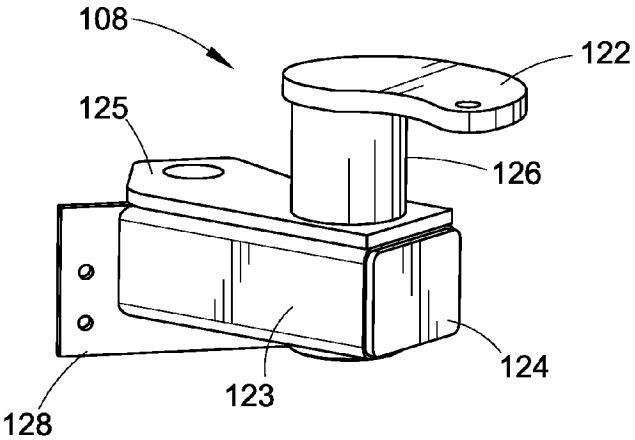
FIG. 8D illustrates a right isometric view of the minor top hub for use in the high-pressure door assembly depicted in FIGS. 1A-4.
Figure 8F:
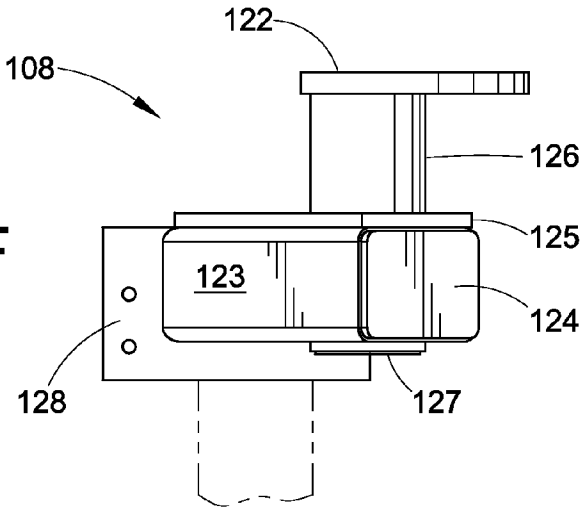
FIG. 8F illustrates a front isometric view of the minor top hub for use in the high-pressure door assembly depicted in FIGS. 1A-4.

FIGS. 5A-5F depict schematic and isometric views of the major hub 107 in accordance with one embodiment of the present disclosure. As shown in FIGS. 5A-5F, the major hub 107 includes a foot 115 that is configured to be moveably coupled to a first end of the connecting bar 113. The hub 107 also includes a major hub arm 116 having a first and second end, with the first end having a hub arm cap 117 attached to it. The major hub 107 further includes an arm top plate 118 that is coupled to a top portion of the major hub arm 116, and which includes a first hole and a second hole. The major hub 107 also includes a forearm 119, that has an end portion coupled to the bottom portion of the foot 115 and that is located at a second end opposite the first end of the foot 115. The forearm 119 is configured to extend through the first hole of the top plate 118 and the major hub arm 116. In addition, a forearm cap 120 is coupled to an end of the forearm 119 opposite the end portion coupled to the bottom portion of the foot 115. Furthermore, the major hub 107 includes a major hub backing plate 121 that is coupled to the second end of the major hub arm 116, the major hub backing plate 121 configured to couple the major hub 107 to the major wing 101. FIG. 6 depicts a top isometric view of the major hub 107 in accordance with the embodiments discussed above with respect to FIGS. 5A-5F. FIG. 7 depicts an isometric view of the bottom of the major hub 107 as discussed in greater detail above with respect to FIGS. 5A-5F.

FIGS. 8A-8F depicts schematic and isometric views of the minor hub 108 in accordance with one embodiment of the present disclosure. As shown in FIG. 3, the minor hub 108 includes a foot 122 that is configured to be moveably coupled to a first end of the connecting bar 113. The minor hub 108 also includes a minor hub arm 123 having a first and second end, with the first end having a hub arm cap 124 attached to it. The minor hub 108 further includes an arm top plate 125 that is coupled to a top portion of the minor hub arm 123, and which includes a first hole and a second hole. The minor hub also includes a forearm 126, that has an end portion coupled to the bottom portion of the foot 122 and that is located at a second end opposite the first end of the foot 122. The forearm 126 is configured to extend through the first hole of the top plate 125 and the minor hub arm 123. In addition, a forearm cap 127 is coupled to an end of the forearm 126 opposite the end portion coupled to the bottom portion of the foot 122.

Figure 9:
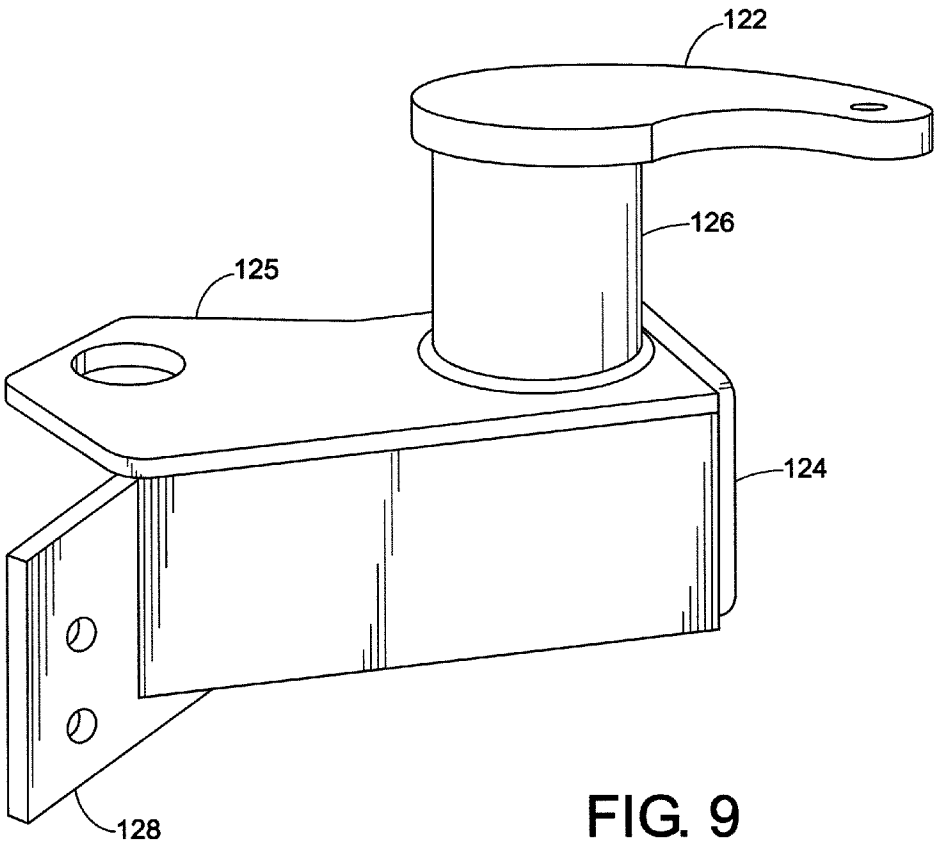
FIG. 9 illustrates a top isometric view of a minor top hub in accordance with the detailed and isometric representations illustrated in FIGS. 8A-8F.

Furthermore, the minor hub 108 includes a minor hub backing plate 128 that is coupled to the second end of the minor hub arm 123. According to one embodiment, the minor hub backing plate 128 is configured to couple the minor hub 108 to the minor wing 102. FIG. 9 depicts a top isometric view of the minor hub 108 in accordance with the embodiments discussed above with respect to FIGS. 5A-5F.

FIGS. 10A-10D depict various views of an assembly of the wings 101-102 according to one example embodiment of the present disclosure. As illustrated in FIGS. 10A-10D, each wing 101-102 includes a top 224 and a bottom 226 mounting bracket configured to receive the hubs 107-110 discussed above with respect to FIGS. 1A-9. In one embodiment, as shown in FIG. 10A, a wing 101 or 102 may include a window 229 of suitable strength and thickness to withstand high-pressure applications so as to allow viewing through the high-pressure mine door assembly 100. The window 229 may be dimensioned so as to avoid impacting the structural integrity of the wing 101 and/or 102 in which the window 229 is emplaced. A 6 inch×6 inch window 229 is illustrated in FIG. 10A as one example of dimensions capable of being included in accordance with the embodiments disclosed herein. Although illustrated in FIGS. 10A-10D as a single piece, the wing 101 or 102 may be a segmented door structure, allowing for assembly within the mine shaft. In such an implementation, a preselected number of segments (not shown) of the wing 101 or 102 may be bolted, fastened or otherwise affixed to each other and vertical structural components of the wing 101 or 102. It will be appreciated that such an implementation allows faster assembly and ease of shipment of the assembly 100, particularly for large doors or small shaft portions of a mine in which the door assembly 100 is to be emplaced.

In some embodiments, the high-pressure door includes at least one sensor operative to detect at least one of a vehicle, minor, control signal, or the like, so as to initiate an opening cycle. In such an embodiment, the door may include one or more sensors 130 configured to detect any obstruction in the path of the wings or in the shaft so as to prevent the wings from closing. In one embodiment, the sensors comprise a pair of sonic sensors, wherein the tripping of a first sensor (in either direction) directs the opening of the door assembly 100, and the tripping of a second sensor (located on an opposing side of the door assembly 100 and facing the opposite direction of the first sensor) directs the closing of the door assembly 100. Other sensors may also be implemented, e.g., a motion sensor operable to detect an object, person, or the like transiting the door assembly 100, as discussed in greater detail herein.

Other embodiments may utilize an automated or remote control system, which uses preprogrammed instructions, receives various sensor inputs, or a combination thereof, to open and close the wings 101-102 of the door assembly 100. For example, pull cords, push buttons, infrared or RF controls, proximity sensors, pressure sensors, manual, etc., may be used in operating the door assembly. In one embodiment, cap link sensors are used to facilitate the opening and closing of the door assembly 100, i.e., sensors used to detect the presence of a miner using a transmitter or other device embedded or affixed to a mining helmet, light source, etc.

The assembly 100 may further include a control system that is configured to control the operation of the assembly 100 in accordance with data received from sensors, programs, manual input, and the like. In such an embodiment, the control system may activate the drive mechanism 112 so as to open the wings 101-102 and allow transiting through the assembly 100, or close the wings 101-102 to prevent airflow from transiting the assembly 100. The control system may be proximally located with respect to the assembly 100, or remotely located therefrom, e.g., above-ground. In some other embodiments, the control system may include manual bypasses allowing operation of the doors when power, air supply, or hydraulics fail.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

What is claimed is:

1. A mine door assembly, comprising:

a frame including a cap frame portion, a sill frame portion, a first post frame portion and a second post frame portion, the cap frame portion and the sill frame portion coupled to respective top and bottom ends of the first post frame and second post frame portions;

a major wing pivotally coupled to the cap frame portion via a major cap bearing and pivotally coupled to the sill frame portion via a major sill bearing, the major wing including a major hub located adjacent to the major cap bearing;

a minor wing pivotally coupled to the cap frame portion via a minor cap bearing and pivotally coupled to the sill frame portion via a minor sill bearing, the minor wing including a minor hub located adjacent to the minor cap bearing;

a connecting bar having a first end moveably coupled to the major hub and a second end moveably coupled to the minor hub; and a drive assembly operatively coupled to the connecting bar and configured to rotate the major and minor wings of the mine door assembly in a common rotational direction such that a majority of the major wing is disposed on one side of the frame when the major wing is in a fully open position and a majority of the minor wing is disposed on another side of the frame opposite the one side of the frame when the minor wing is in a fully open position;

wherein the major hub includes a foot having an attachment portion moveably coupled to the first end of the connecting bar, a major hub arm including a first end and a second end, the first end of the major hub arm including a hub arm cap attached thereto, an arm top plate coupled to a top portion of the major hub arm, the arm top plate including a first hole and a second hole, a forearm, a first end of the forearm coupled to the foot, the forearm extending through the first hole of the arm top plate and extending through the major hub arm, a forearm cap coupled to a second end of the forearm opposite the first end of the forearm, and a major hub backing plate coupled to the second end of the major hub arm, the major hub backing plate coupled to the major wing.

2. The mine door assembly of claim 1, wherein the drive assembly has a longitudinal axis which is approximately parallel to a longitudinal axis of the connecting bar, the drive assembly configured to apply a force so at to rotate the wings.

3. The mine door assembly of claim 2, wherein the drive assembly is coupled to the cap frame portion and coupled to a pivot on the connecting bar.

4. The mine door assembly of claim 1, wherein the minor hub comprises:

a minor hub foot moveably coupled to the second end of the connecting bar;

a minor hub arm including a first end and a second end, the first end of the minor hub arm including a minor hub arm cap attached thereto;

a minor hub arm top plate coupled to a top portion of the minor hub arm, the minor hub arm top plate including a first hole and a second hole;

a minor hub forearm, a first end of the minor hub forearm coupled to the minor hub foot, the minor hub forearm extending through the minor hub arm and the first hole of the minor hub arm top plate;

a minor hub forearm cap coupled to a second end of the minor hub forearm opposite the first end of the minor hub forearm; and a minor hub backing plate coupled to the second end of the minor hub arm, the minor hub backing plate couples the minor hub to the minor wing.

5. The mine door assembly of claim 4, wherein the drive assembly is selected from the group consisting of a pneumatic drive, an electric drive, a hydraulic drive, and a manual drive.

6. The mine door assembly of claim 5, wherein the drive assembly is attached to the cap frame portion via a pin.

7. The mine door assembly of claim 5, wherein the connecting bar is connected to the major hub and the minor hub via pins.

* * * * *